United States Patent [19]

Wengen

[11] 3,995,440

[45] Dec. 7, 1976

[54] VAPOR CONTROL SYSTEM

[75] Inventor: George E. Wengen, New Castle, Del.

[73] Assignee: Sun Oil Company of Pennsylvania, Philadelphia, Pa.

[22] Filed: Dec. 24, 1975

[21] Appl. No.: 644,210

[52] U.S. Cl. ..... 62/54; 62/185; 62/402; 220/85 VR

[51] Int. Cl.[2] ..... F17C 7/02

[58] Field of Search ..... 55/88, 89; 220/85 VR, 220/85 VS; 62/54, 86, 87, 88, 401, 402, 403, 430, 434, 435, 467 PR, 185

[56] References Cited

UNITED STATES PATENTS

| | | | |
|---|---|---|---|
| 2,893,218 | 7/1959 | Harnish | 62/435 X |
| 3,002,362 | 10/1961 | Morrison | 62/86 X |
| 3,221,511 | 12/1965 | Garrett | 62/87 X |
| 3,535,210 | 10/1970 | Linde et al. | 62/333 X |

*Primary Examiner*—William E. Wayner
*Assistant Examiner*—Ronald C. Capossela
*Attorney, Agent, or Firm*—J. Edward Hess; Donald R. Johnson; William C. Roch

[57] ABSTRACT

A system for preventing substantial pollution of the atmosphere by benzene vapors displaced from a tank truck during loading of the truck with benzene. The benzene is loaded into the truck at its ambient temperature, and benzene vapors displaced from the truck are cooled to condense them to a liquid state. The system for cooling the benzene vapors is one in which natural gas at high pressure is expanded to a lower pressure, and the cooling effect which takes place during the expansion is utilized to cool and condense the benzene vapors.

17 Claims, 1 Drawing Figure

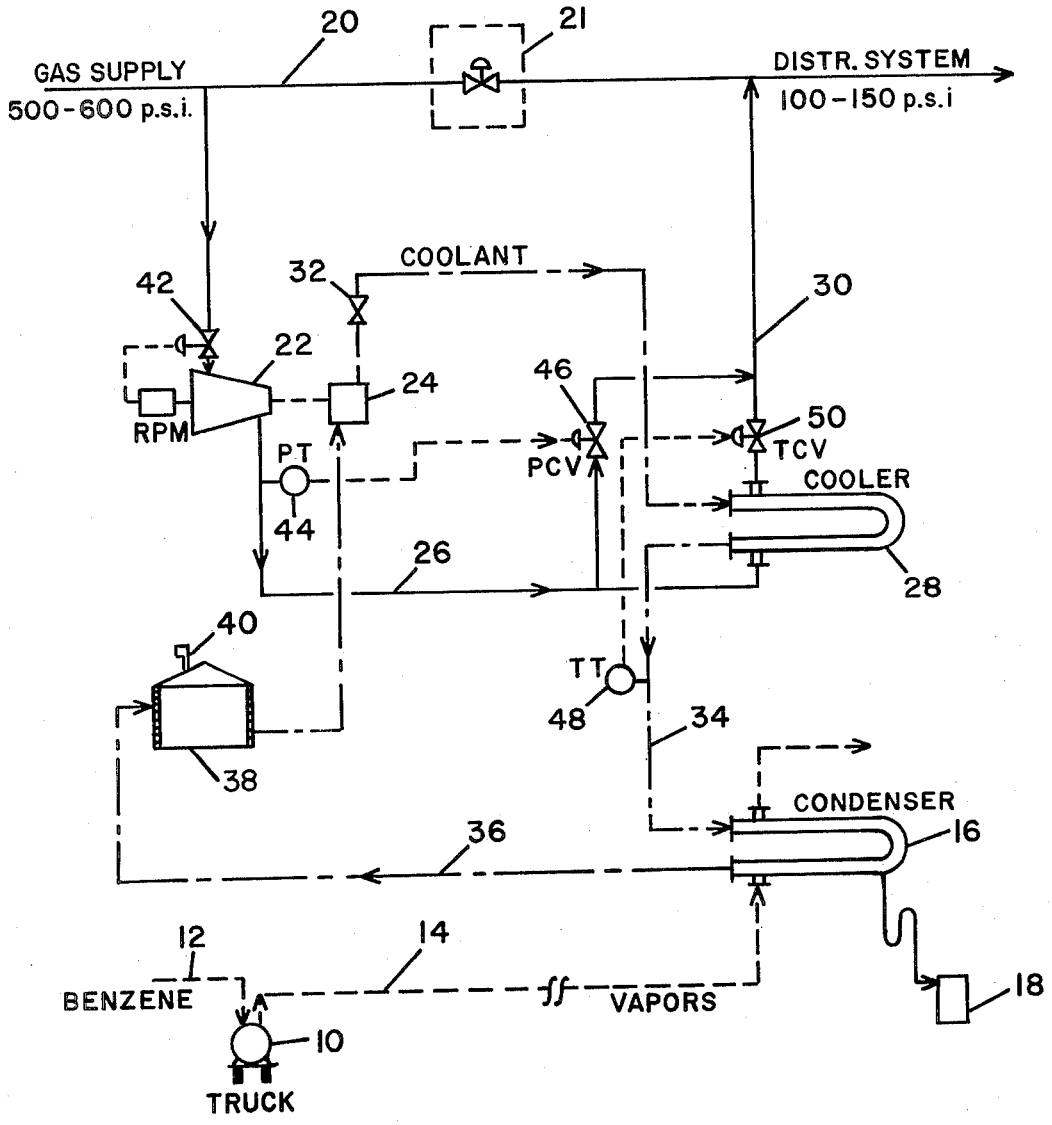
20
21
GAS SUPPLY
500-600 p.s.i.
DISTR. SYSTEM
100-150 p.s.i
COOLANT
32
42
30
22
24
46
50
RPM
PT
PCV
TCV
COOLER
44
26
28
40
TT
48
34
38
CONDENSER
36
16
12
14
BENZENE
VAPORS
18
10
TRUCK

VAPOR CONTROL SYSTEM

BACKGROUND OF THE INVENTION

The present invention relates generally to a vapor control system, and more particularly relates to a vapor control system designed to minimize the escape of benzene vapors into the atmosphere during the loading of liquid benzene into a tank truck. Recently enacted Environmental Protection Agency regulations governing loading of volatile substances into tank trucks specify that a vapor control system is required for substances which have a vapor pressure exceeding 1.5 psia at loading temperature and wherein the loaded volume exceeds 20,000 gallons per day. The present invention was designed to comply with EPA standards during the loading of benzene into tank trucks.

SUMMARY OF THE INVENTION

In accordance with a preferred embodiment, a system is disclosed for reducing pollution of the atmosphere by chemical vapors within a chemical handling area having a supply of gas at a relatively high pressure. The chemical vapors are contained and directed to a condenser for condensation. The high pressure gas is directed through a turbine, wherein it is expanded and cooled as a result of the expansion. The turbine drives a pump which pumps coolant through a heat exchanger and then through the condenser. The heat exchanger is cooled by the low temperature gas exiting from the turbine.

In accordance with the teachings of the present invention, a vapor control system is disclosed in which the operating costs are essentially zero, and in which on-stream operation should require no supervision by plant personnel. Further, the disclosed embodiment should be able to operate continuously, requiring no shut down of the equipment between successive operations.

BRIEF DESCRIPTION OF THE DRAWING

The FIGURE illustrates a flow diagram of one embodiment of the present invention.

DETAILED DESCRIPTION OF THAT EMBODIMENT

Referring to the Figure, there is illustrated a flow diagram of one embodiment of the present invention wherein the flow of natural gas is indicated by a solid line, the flow of coolant is illustrated by a dashed-dotted line, and the flow of benzene is illustrated by a dotted line. A tank truck 10 is shown being filled from a benzene supply line 12. The tank truck has a sealed hatch on its top, not shown in detail, which prevents benzene vapors from escaping directly into the atmosphere. The sealed hatch has a vapor removing pipe 14 attached thereto such that as benzene vapors are displaced from the tank truck during filling, they are directed into pipe 14 where they are transported to a condenser 16. They are cooled in the condenser, in a manner as will be explained later, and are condensed into a storage drum 18. In an alternative embodiment, the condensed liquid might be pumped directly to benzene tanks in the refinery.

The cooling system of the disclosed embodiment operates as follows. Natural gas is received at the refinery over a supply pipe 20 at a very high pressure, ordinarily 500–600 psi. The pressure of the natural gas must be reduced to a lower pressure, generally 100–150 psi, by a pressure break down station 21 before it enters a general distribution system in the refinery. A tremendous amount of heat is absorbed during this expansion because of the heat of expansion of the natural gas, and ordinarily the potential work of this cooling effect is disregarded. The preferred embodiment takes advantage of this cooling effect for both supplying power to the system and cooling the benzene vapors. The natural gas is expanded through a turbine 22 which drives a coolant pump 24. The expanded, cooled natural gas is directed via a pipe 26 to a heat exchanger 28. The natural gas is then returned via a pipe 30 to the low pressure side of the break down station 19 where it enters the general distribution system 31 for the refinery.

Most of the coolant pressure after the pump 24 is dissipated across a partially opened plug disc globe valve 32. The coolant, which in the preferred embodiment is kerosene, then flows into cooler 28 where its temperature is substantially reduced, and continues via pipe 34 to condenser 16 where it is utilized to cool the benzene vapors. The kerosene coolant is then directed by a pipe 36 to an insulated holding tank 38 which is vented at 40 to provide kerosene at atmospheric pressure to the pump 24.

The preferred embodiment is designed to be automatically self-controlled, with operator assistance required only at start up. The coolant circulation is to be maintained at all times, and thus there is no need to start and stop the system for each truck loading. The system includes three self-regulating controls. A turbine governor control 50 includes an RPM meter which controls the opening of a valve to maintain the RPM of the turbine 22 steady at some predetermined value. A pressure control system includes a pressure transducer 44 and a control valve 46 which function together to control the amount of natural gas bypassing the cooler 28, and accordingly control the pressure in the cooling loop beyond the turbine. A temperature control system includes a temperature transducer 48 and a control valve 50 which function together to maintain the temperature of the coolant at a given value. Because of the nature of these controls, the system can run continuously, even when no vapor is flowing through condenser 16, as the combination of the temperature/pressure control systems admits only enough gas to the cooler to maintain the coolant temperature at a selected value.

By way of specific example, one embodiment was designed with the following parameters. All of the natural gas piping was two inches, insulated before the cooler 28 to keep heat absorption to a minimum, and uninsulated after the cooler to allow the natural gas to warm before it enters the general distribution system of the refinery. The gas is received from a supplier at a pressure of approximately 500–600 psi, and the pressure is reduced to 100–150 psi before it enters the general distribution system. The turbine 22 is a small (15 hp) non-condensing gas expansion turbine with a constant speed governor, as is available from Coppus Engineering. The coolant pump 24 is designed for a flow of 61 gpm at 140 psig discharge pressure. This high flow and discharge pressure is required to consume enough driver power to ensure a sufficient flow of natural gas for cooling. The expansion of the natural gas through the turbine gives a gas temperature of approximately 0° F, and the cooled gas flow is regulated to give the kerosene coolant at 55° F temperature into the condenser. The kerosene cooler and the vapor condenser are standard Brown Fin Tube units. The cooler is an all-steel, type 1JH24, 15 foot long cooler, while the condenser is an all-steel, type 1JH36, 20 foot long condenser. Gas streams flow on the fin sides of both exchangers, while kerosene circulates on the tube sides of both exchangers. These exchangers have the inherent flexibility of adding capacity by simply stacking on additional sections. The temperature control system maintains the circulating kerosene coolant at 54°–55° F. The kerosene holding tank has a capacity of 100 gallons, and the storage drum is a 55 gallon drum. The kerosene circulation lines are all 2 inch insulated piping. The air-benzene vapors displaced from the tank truck have a pressure of approximately 3 inches ($H_2O$), and the vapors vented into the atmosphere are cooled to approximately 65° and have a pressure of approximately 1 inch ($H_2O$). In the designed embodiment, each control loop would use a feed into the transducer appropriate to that application, i.e. speed measurement could be electrical, pressure measurement would be by a direct pressure feed to the transducer, etc. Conventional transducer control systems would then be used to convert the input signal into an output air pressure signal (usually 3 to 15 psig) sent to the appropriate control valve. For example, the RPM sensor (probably electromagnetic) would feed an electrical signal proportional to RPM into the transducer, where the difference between the process and set point signals would generate an air pressure to the control valve to regulate incoming steam into the turbine. There are new transducers available which operate completely electronically. They receive an input signal appropriate to the variable being measured, and send an electric output signal to the valve. Since the control loops are intended to be "local" control (controlling on location rather than transmitting signals to and from a control room), these electronic transducer controllers probably would not be used. They have a big advantage in applications where the unit is located a sizeable distance from its control room.

Although at least one embodiment of the present invention has been described, the teachings of this invention will suggest many other embodiments to those skilled in the art.

The invention claimed is:

1. A system for reducing pollution of the atmosphere by chemical vapors within a chemical handling area having a supply of gas at a relatively high pressure which requires expansion to a lower pressure, and comprising:

a. means for containing the chemical vapors to prevent their being vented into the atmosphere;

b. a condenser having the contained chemical vapors directed thereto and adapted to cool and condense the chemical vapors;

c. a coolant adapted to flow through and cool the condenser;

d. a pump for circulating the coolant through the system;

e. a turbine means, powered by said high pressure gas, for driving said pump and adapted to release the gas at a lower usable pressure and lower temperature due to the expansion of the gas through the turbine means; and f. a heat exchanger means for cooling said coolant with said lower temperature gas, whereby the expansion of the gas from a higher to a lower pressure is utilized to both drive and cool the system.

2. A system as set forth in claim 1 wherein the chemical vapors are displaced during the loading of a tank truck, and said means for containing the chemical vapors includes a means for sealing the tank on the truck and a pipe means for directing the displaced chemical vapors from the tank truck to said condenser.

3. A system as set forth in claim 1 wherein said supply of gas includes a supply of natural gas.

4. A system as set forth in claim 3 wherein the chemical vapors are displaced during the loading of a tank truck, and said means for containing the chemical vapors includes a means for sealing the tank on the truck and a pipe means for directing the displaced chemical vapors from the tank truck to said condenser.

5. A system as set forth in claim 4 and including means for directing the gas exiting from said heat exchanger means to a low pressure, general distribution system for the chemical handling area.

6. A system as set forth in claim 5 wherein said chemical handling area includes a pressure breakdown station for expanding the relatively high pressure gas to a lower, pressure usable in said general distribution system, and available because of the expansion and cooling during expansion is disregarded.

7. A system as set forth in claim 6 and including means for providing a closed circulation system for the coolant which directs the coolant from said pump to said heat exchanger, to said condenser, and then back to said pump.

8. A system as set forth in claim 7 wherein said turbine means includes a turbine governor means for regulating the supply of gas to the turbine to maintain the speed of the turbine means relatively constant.

9. A system as set forth in claim 8 and including a temperature control means for measuring the temperature of the coolant, and for regulating the flow of the coolant through said closed circulation system to maintain the temperature at a substantially constant temperature.

10. A system as set forth in claim 9 and including a pressure regulator means for measuring the pressure of the gas exiting from said turbine means, a bypass pipe around said heat exchanger for said gas, and means for controlling the amount of gas bypassing said heat exchanger means to maintain the pressure of the gas relatively constant at a predetermined pressure.

11. A system as set forth in claim 1 and including means for directing the gas exiting from said heat exchanger means to a low pressure, general distribution system for the chemical handling area.

12. A system as set forth in claim 11 wherein said chemical handling area includes a pressure breakdown station for expanding the relatively high pressure gas to a lower, pressure usable in said general distribution system, and in which the potential work available because of the expansion and cooling during expansion is disregarded.

13. A system as set forth in claim 1 and including means for providing a closed circulation system for the coolant which directs the coolant from said pump to said heat exchanger, to said condenser, and then back to said pump.

14. A system as set forth in claim 13 including a temperature control means for measuring the temperature of the coolant, and for regulating the flow of the coolant through said closed circulation system to maintain the temperature at a substantially constant temperature.

15. A system as set forth in claim 14 and including a storage tank for said coolant interposed between said condenser and said pump.

16. A system as set forth in claim 1 wherein said turbine means includes a turbine governor means for regulating the supply of gas to the turbine to maintain the speed of the turbine means relatively constant.

17. A system as set forth in claim 1 and including a pressure regulator means for measuring the pressure of the gas exiting from said turbine means, a bypass pipe around said heat exchanger for said gas, and means for controlling the amount of gas bypassing said heat exchanger means to maintain the pressure of the gas relatively constant at a predetermined pressure.

* * * * *